US009815312B2

(12) United States Patent
Pal et al.

(10) Patent No.: US 9,815,312 B2
(45) Date of Patent: Nov. 14, 2017

(54) PRINT MEDIA WITH A TOP COATING

(75) Inventors: Lokendra Pal, San Diego, CA (US); Xulong Fu, San Diego, CA (US); Julio Cesar Alonso, Temecula, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/385,985

(22) PCT Filed: Apr. 17, 2012

(86) PCT No.: PCT/US2012/033929

§ 371 (c)(1),
(2), (4) Date: Sep. 17, 2014

(87) PCT Pub. No.: WO2013/158078

PCT Pub. Date: Oct. 24, 2013

(65) Prior Publication Data

US 2015/0050435 A1 Feb. 19, 2015

(51) Int. Cl.

| | |
|---|---|
| ***B41M 5/50*** | (2006.01) |
| ***B05D 7/00*** | (2006.01) |
| ***B41M 5/52*** | (2006.01) |

(52) U.S. Cl.

CPC ..... *B41M 5/506* (2013.01); *B05D 7/54* (2013.01); *B41M 5/502* (2013.01); *B41M 5/5218* (2013.01); *B41M 5/5245* (2013.01); *B41M 2205/34* (2013.01); *B41M 2205/38* (2013.01); *B41M 2205/40* (2013.01)

(58) Field of Classification Search

CPC .. B41M 5/506; B41M 5/5218; B41M 5/5245; B41M 2205/38; B05D 7/50; B05D 7/54

USPC ..... 428/32.24, 32.25, 32.29, 32.3, 32.34, 428/32.35; 427/243

See application file for complete search history.

(56) References Cited

U.S. PATENT DOCUMENTS

| | | | | |
|---|---|---|---|---|
| 6,312,858 | B1 | 11/2001 | Yacobucci et al. | |
| 6,692,799 | B2 | 2/2004 | Waller, Jr. | |
| 7,073,899 | B2 | 7/2006 | Kida et al. | |
| 8,052,271 | B2 | 11/2011 | Kunimine et al. | |
| 2002/0034615 | A1* | 3/2002 | Otani et al. | 428/195 |
| 2003/0114573 | A1* | 6/2003 | Cuch et al. | 524/492 |
| 2003/0180523 | A1* | 9/2003 | Parrinello | B41M 5/52 428/315.5 |

(Continued)

FOREIGN PATENT DOCUMENTS

| | | | |
|---|---|---|---|
| CN | 101980872 | A | 2/2011 |
| EP | 0712735 | A1 | 5/1996 |

(Continued)

OTHER PUBLICATIONS

Extended European Search Report for EP Application No. 12874611 dated Mar. 11, 2015.

*Primary Examiner* — Betelhem Shewareged
(74) *Attorney, Agent, or Firm* — HP Inc. Patent Department

(57) ABSTRACT

In one example, a print medium includes pigment particles sized less than a hundred nanometers and frictional control additives. An undercoating is disposed between the base material and top coating. The undercoat includes a first sub-layer comprising a pigment fixative agent and a second sub-layer comprising a dye fixative agent. The top coating forms a protective and low friction coating over the undercoating.

17 Claims, 4 Drawing Sheets

(56) References Cited

U.S. PATENT DOCUMENTS

| | | | | |
|---|---|---|---|---|
| 2003/0186003 | A1* | 10/2003 | Nakano et al. | 428/32.1 |
| 2003/0207052 | A1 | 11/2003 | Niu et al. | |
| 2005/0008794 | A1 | 1/2005 | Graczyk et al. | |
| 2005/0195261 | A1* | 9/2005 | Stelter | B41J 2/0057<br>347/102 |
| 2007/0134450 | A1* | 6/2007 | Campbell et al. | 428/32.34 |

FOREIGN PATENT DOCUMENTS

| | | | |
|---|---|---|---|
| EP | 1048479 | A2 | 11/2000 |
| EP | 1321300 | | 6/2003 |
| EP | 1612054 | A1 | 1/2006 |
| EP | 1705027 | A1 | 9/2006 |
| EP | 2261043 | A1 | 12/2010 |
| KR | 10-20040108216 | | 12/2004 |
| WO | WO-2007/100481 | A1 | 9/2007 |

* cited by examiner

PRINT MEDIA WITH A TOP COATING

BACKGROUND

Inkjet printing involves dispensing ink droplets onto a surface of a print medium as the print medium is conveyed past the print head of the ink jet printer. Colorant in the ink droplets contacts the surface of the print medium and binds to it. In some examples, a coating is applied on the surface of the print medium before printing. When the medium is coated, the colorant may bind to fixative agents, such as cationic agents, in the coating that are attracted to an electrostatic negative charge of the colorant.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

Figure 1:
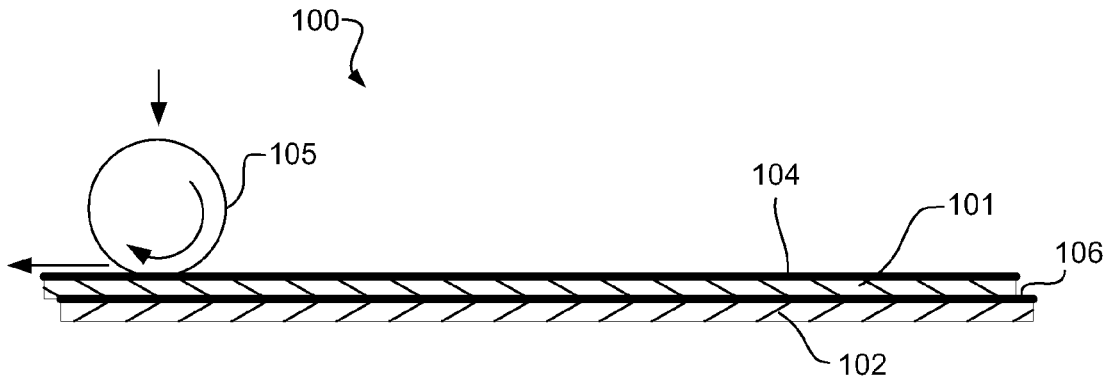
FIG. 1 is a diagram of illustrative printing media, according to principles described herein.

A print medium surface coating may have a variety of finishes. For example, gloss coatings have a high specular reflectance and give the medium a shiny look. Matte finishes diffuse reflected light. The diffused light reflects light in different directions, but does not provide the same shine achieved with gloss coatings. Generally, matte coatings use larger particles than gloss finishes giving high optical roughness and diffusing reflectance.

Surface coatings also exhibit coefficients of friction that are utilized to move media with respect to the print head. Often, a rubber roller presses down on and rotates against the surface of the medium with enough force to move a single sheet of the media. If the pressure is too great, more than one sheet is moved. On the other hand, if an insignificant force is applied to the roller, the top sheet will not move as desired, if the top sheet moves at all. Printers that consistently convey a single sheet of the media though the printer as desired are considered to have good sheet feed reliability. A sheet's surface characteristics, coefficient of friction, and intimate contact with other media and/or printer tray may influence the sheet feed reliability.

The present specification describes subject matter including, for example, a print medium with a plurality of coatings applied to a surface of a base material. The top coating may provide a low coefficient of friction that provides sheet feed reliability as printing media are conveyed through an ink jet printer. Examples of such a print medium may include a top coating with a protective surface that is made of pigment particles sized less than hundred nanometers and friction controlling agents. Further, the medium may have an undercoating that contains colorant fixative agents.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

FIG. 1 is a diagram of illustrative printing media (100), according to principles described herein. In this example, a top sheet (101) and an underlying sheet (102) of the media are shown. Both of the sheets (101, 102) are coated with a plurality of coatings (103). These coatings will be described in more detail below.

As a roller (105) is pressed against the top sheet (101), the roller (105) may rotate causing the top sheet to move. The friction between the low friction surface (104) of the top sheet (101) and the roller (105) is a factor in determining the amount of downward pressure that should be applied to the roller (105) to move a single sheet. In these examples, the underlying sheet (102) has a plurality of coatings that minimize friction between a top surface (106) of the underlying sheet (102) and an underside of the top sheet (101). The low friction provided by the plurality of coatings (103) reduces the downward force necessary to operate the roller to move a single sheet of media and provides greater sheet feed reliability.

Figure 2:
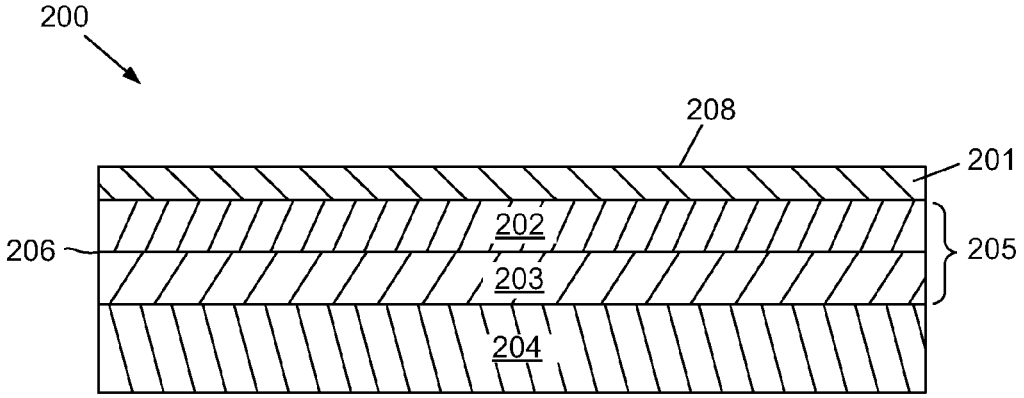
FIG. 2 is a cross sectional diagram of an illustrative print medium, according to principles described herein.

FIG. 2 is a cross sectional diagram of an illustrative print medium (200), according to principles described herein. In this example, the medium (200) has a top coating (201) and an undercoating (205) deposited on a base material (204). The undercoating (205) has a first sub-layer (202) and a second sub-layer (203). The top coating (201) may be a friction control coating, and the undercoating (205) may be a colorant fixative coating.

The base material (204) may be a fiber based material, a plastic, a transparent material, an opaque material, paper, cardstock, fabric, other base materials used in printing media, or combinations thereof. In some examples, the base material (204) is pre-coated to improve adhesion between the base material (204) and the undercoating (205).

In one example, the base material (204) is made from cellulosic fibers. In another example, the base material (204) is made from synthetic fibers such as, for example, polyamides, polyesters, polyethylene, and polyacrylic fibers. In yet another example, the base material (204) is made from inorganic fibers such as, for example, asbestos, ceramic, and glass fibers. In still another example, the base material (204) may be made of a combination of the above materials. The base material (204) may be formed in any dimension, size, or thickness. Further, the base material (204) may be of any form such as, for example, pulp, wet paper, or dry paper. Further, the base material (204) may comprise a mixture of fibers, for example, wood fibers, non-wood fibers, and recycled fibers. The base material (204) may be printing paper such as, for example, inkjet printing paper, and may further include other forms of paper such as writing paper, drawing paper, and photobase paper, as well as board materials such as cardboard, poster board, and Bristol board.

The fibers may be produced from chemical pulp, mechanical pulp, thermal mechanical pulp, chemical mechanical pulp, and chemi-thermomechanical pulp (CTMP), for example. Examples of wood pulps include, but are not limited to, kraft pulps and sulfite pulps, each of which may or may not be bleached. Examples of softwoods include, but are not limited to, pines, spruces, and hemlocks. Examples of hardwoods include, but are not limited to, birch, maple, oak, poplar and aspen.

In the example of FIG. 2, the undercoating (205) has two sub-layers (202, 203) that each include colorant fixative agents. The colorants in the ink may be dye colorants, pigment colorants, or combinations thereof. A dye is a material that is soluble in the ink and bonds with the dye fixative agents originating in the second sub-layer (203). A pigment is an insoluble material that bonds with the pigment fixative agents originating in the first sub-layer (202).

In the example of FIG. 2, the first sub-layer (202) is positioned adjacent to the base material (204). This sub-layer (202) may include pigment fixative agents. A non-exhaustive list of pigment fixative agents that may be used in the first sub-layer (202) includes multi-valent salts, calcium chloride ($CaCl_2$), calcium acetate ($Ca(C_2H_3OO)_2$), calcium citrate ($Ca_3(C_6H_5O_7)_2$), magnesium sulfate ($MgSO_4$), aluminum chlorohydrate ($Al_nCl_{(3n-m)}(OH)_m$), or combinations thereof.

In the example of FIG. 2, the second sub-layer (203) may have dye fixative agents. A non-exhaustive list of dye fixative agents that may be used in the first sub-layer (202) includes cationic fixative agents, polydiallyldimethylammonium chloride (PolyDADMAC), polyamines, polyhexamethylene biguanide (PHMB), other dye fixative agents, or combinations thereof.

A boundary (206) may separate the first sub-layer (202) from the second sub-layer (203). The boundary (206) may be formed by applying each of the sub-layers (202, 203) separately.

The top coating (201) may be deposited over the undercoating (205). The top coating (201) may have a porous structure that pulls colorant and/or ink that is deposited on the top coating's protective surface (208) into the plurality of coatings through a capillary force.

The top coating (201) include clay particles, mineral particles, ground calcium carbonate, precipitated calcium carbonate, talc particles, silica particles, alumina particles, or combinations thereof. These materials may have small particles that are sized less than a hundred nanometers. In some examples, the average particle size is between fifteen and eighty five nanometers. In other examples, the average particle size is between thirty and seventy nanometers. Yet, in other examples, the average particle size is around forty five to fifty five nanometers.

The high surface area of the small particles may provide the protective surface (208) of the top coating (201) with a highly porous structure that creates a strong capillary force that pulls the ink and/or colorant into the top coating (201) and sublayers. In the top coating (201), the capillary forces are greater when particle sizes are smaller because the spacing between the particles is also smaller. A top coating (201) with pigment particles sized under a hundred nanometers creates a strong capillary force. Thus, the ink and/or colorant may be pulled through these pores into the undercoating through capillary action relatively rapidly. The small particles also lower the friction of the top coating (201) thereby increasing the print medium's sheet feed reliability.

The top coating (201) may also include friction control additives. The friction control additives may have a liquid state at room temperature allowing the additives' molecules to move until they settle at their lowest surface energy state. The friction control additives may contribute to reducing the coefficient of friction on the top coating's surface (208) by lowering the top coating's surface energy. The lower coefficient of friction prevents objects from damaging printed images on the print medium and its coatings. For example, water and objects that come into contact with the top coating's surface will slide off the print medium more readily without catching or bonding the top coating's surface. Further, the predictable coefficient of friction may increase the medium's sheet feed reliability.

The friction control additives may be a non-polar hydrocarbon synthetic polymer emulsion or dispersion, such as high density or low density polyethylene ($(C_2H_4)_n$); a synthetic polymer with high molecular weight and a solid micro-particle physicals form, such as high density polyethylene powder; waxes such as carnauba and paraffin, lubricants, other friction control additive, or combinations thereof. Suitable examples of friction control additives that may be compatible with the principles described herein are Michem Shield®, Michem Lube®, and Michem Emulsion® which may be obtained through Michelman, Inc. located in Cincinnati, Ohio. Another friction control additive that may be compatible with the principles described herein is Ultralube™, which is marketed by Friction Solutions, LLC located in Tulsa, Okla.

In some examples, the top coating has a ratio of pigment particles to friction control additives between approximately 50:50 and 99:1. In yet other examples, the top coating has a ratio of pigment particles to friction control additives between approximately 90:10 and 99:1.

The small size of these top coating's particles may keep the top coating's coefficient of friction low. The particles may be configured to reflect the incoming light to reflect at a desired angle or range of angles and can produce gloss, matte, and other coating finishes.

The top coating (201) may be relatively thin. In some examples, the top coating (201) has a thickness under ten micrometers. In some examples, the thickness of the top coating is less than five micrometers. Yet, in other examples, the thickness is less than one micrometer. In some examples, the thickness is less than 0.5 micrometer.

In some examples, the top coating (201) has a coating weight of less than ten grams per square meter. In some examples, the top coating (201) has a coating weight that is less than five grams per square meter. Yet, in other examples, the top coating (201) has a coating weight that is less than one gram per square meter.

The undercoating (205) may have an undercoat weight that is less than thirty grams per square meter. In some examples, the top coating has a coating weight that is less than twenty five percent of the undercoat weight. In some examples, the undercoat weight is less than one gram per square meter. In some examples, the undercoat weight is less than twenty grams per square meter. In some examples, the first sub-layer (202) of the undercoating (205) weighs about twenty grams per square meter. In some examples, the second sub-layer (203) is ten grams per square meter. For example, the undercoat weight may be less than twenty grams per square meter with the first sub-layer comprising a coat weight of at least 3 grams per square meter and the second sub-layer comprising a coat weight of at least 5 grams per square meter.

In some examples, the materials of the top coating (201) and the undercoating (205) are applied on a single side of the base material (204). In other examples, the materials are applied on both sides of the base material (204).

Figure 3:
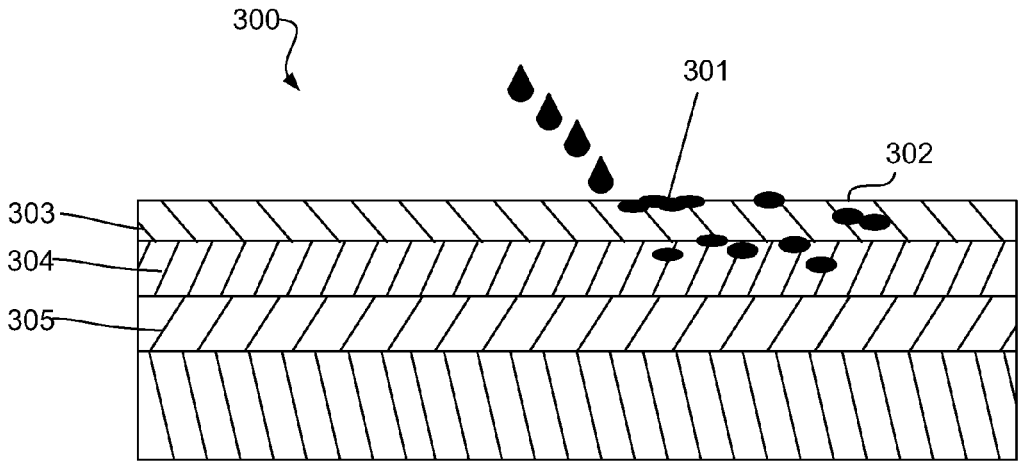
FIG. 3 is a cross sectional diagram of an illustrative print medium, according to principles described herein.

FIG. 3 is a cross sectional diagram of an illustrative print medium (300), according to principles described herein. In this example, ink (301) with a dye or pigment colorant is deposited on a surface (302) of a top coating (303). Some of the colorant (301) is pulled through the pores of the top coating's thickness, while other colorant remains on the surface (302) of the top coating (303). Dye colorant may have a smaller size than the pigment colorant, so a greater proportion of dye colorant may be pulled through the top coating (303).

Once below the top coating (303), the colorants (301) may bind with the fixative agents of the second sub-layer (304). The second sublayer (304) may have a combination of dye and pigment fixative agents even though the pigment fixative agents were deposited in the first sublayer (305) because the pigment fixative agents may diffuse into the second sub-layer (304). The colorants (301) bonded in the second sub-layer (304) may form an image when viewed through the top coating (303). The dye fixative agents may retain the dye (301) in the second sub-layer (304). Further, pigment fixative agents may help retain the pigment colorants on a surface of top coating (303).

In examples that use pigment colorant, most of the pigment may remain on the surface (302) of the top coating (303) because the pigment colorants may be too large to penetrate through the pores of the top coating (303). Additionally, the pigment fixative agents may diffuse into the top coating (303) and cause the pigment colorants molecules to bond to one another, which improves the print quality of the images formed by the colorant. In some examples, dye fixative agents also diffuse into the top coating (303) and bond to dye colorant remaining on the surface (302).

During a print job, the colorant may be retained on the surface (302) of the top coating (303), within the thickness of the top coating (303), and within the thickness of the second sub-layer (304). Both the dye and pigment fixative agents may prevent the colorants (301) from spreading, diffusing, wicking, or otherwise moving from the location where the colorant originally binds in the second sub-layer (304) or top coating (303).

In some implementations, the top coating (303), the second sub-layer (304), and the first sub-layer (305) may have some transparency so that colorant bonded to the first or second sub-layer (304, 305) may be viewed when looking at the top coating (303). In some examples, the top coating (303) is more opaque and the print quality is best when the colorant remains on the surface (302) of the top coating (303).

In some examples, the top coating (303) has a coat weight of 0.5 grams per square meter and is made of a hundred parts of Cartacoat® K303C, a commercial form of silica marketed by Clariant Corporation located in Charlotte, N.C.; three parts of Mowiol® 18-88, a commercial form of polyvinyl alcohol ($(C_2H_4O)_x$) marketed by Sigma-Aldrich headquartered in St. Louis, Mo.; 0.5 parts of Michemshield® 253 slip aid acting as a friction control additive; 0.5 parts of an optical brightening agent; and 0.005 parts of a blue dye. In some examples, the top coating (303) has a coat weight of 0.5 grams per square meter and is made of a hundred parts of Cartacoat® K303C; three parts of Mowiol® 18-88, a commercial form of polyvinyl alcohol ($(C_2H_4O)_x$) marketed by Sigma-Aldrich headquartered in St. Louis, Mo.; one parts of Michemshield® 253 slip aid acting as a friction control additive; 0.5 parts of an optical brightening agent; and 0.005 parts of a blue dye. In some examples, the top coating (303) has a hundred parts of Laponite® JS Nano Clay, which is commercial forms of clay marketed by Rockwood Additives Limited located in Widnes, Cheshire, United Kingdom; three parts of Mowiol® 18-88, a commercial form of polyvinyl alcohol ($(C_2H_4O)_x$) marketed by Sigma-Aldrich headquartered in St. Louis, Mo.; one parts of Michemshield® 253 slip aid acting as a friction control additive; 0.5 parts of an optical brightening agent; and 0.005 parts of a blue dye.

Table 1 below includes specific examples of formulations of top coatings that may be used with the principles described herein.

TABLE 1

| Top Coating Examples | Cartacoat ® K303C | Laponite ® JS | Mowiol ® 18-88 | Michemshield ® 253 | Tinopal ABP-A | Irgalite Blue R-L | Total Parts | Coat weight (gsm) |
|---|---|---|---|---|---|---|---|---|
| 3.1 | 100 | | 3 | 0.5 | 0.5 | 0.005 | 104.005 | 0.5 |
| 3.2 | 100 | | 3 | 1 | 0.5 | 0.005 | 104.505 | 0.5 |
| 3.3 | | 100 | 3 | 1 | 0.5 | 0.005 | 104.505 | 0.5 |

In some examples, the second sub-layer (304) has coat weight of three grams per square meter. In some examples, the second sub-layer (304) has a hundred parts of Sylojet® A25, commercial forms of silica. Sylojet® A25 is marketed by W. R. Grace & Co. located in Columbia, Md. In some examples, the second sub-layer (304) may also have twenty parts of Mowiol® 18-88. In some examples, the second sub-layer (304) has five parts of Glascol® F207, an organic polyelectrolyte marketed by BASF; polyvinyl pyrrolidone ($(C_6H_9NO)_n$) marketed by Sigma-Aldrich headquartered in St. Louis, Mo.; or polyhexamethylene biguanide (PHMB) by Avecia Inc., Wilmington, Del. In some examples, the second sub-layer (304) has 0.5 parts of an optical brightening agent and 0.005 parts of a blue dye.

Table 2 below includes specific examples of formulations of second sub-layers that may be used with the principles described herein.

TABLE 2

| Second sub-layer Examples | Sylojet ® A25 | Mowiol ® 18-88 | Glascol ® F207 | PVP (Polyvinylpyrrolididone) 360 | Polyhexamethylene Biguanide (PHMB) P20D | Tinopal ABP-A | Irgalite Blue R-L | Total Parts | Coat weight (gsm) |
|---|---|---|---|---|---|---|---|---|---|
| 2.1 | 100 | 20 | 5 | | | 0.5 | 0.005 | 125.505 | 3 |
| 2.2 | 100 | 20 | | 5 | | 0.5 | 0.005 | 125.505 | 3 |
| 2.3 | 100 | 20 | | | 5 | 0.5 | 0.005 | 125.505 | 3 |

In some examples, the first sub-layer (305) has forty parts of Hydrocarb® 90, a commercial form of calcium carbonate marketed by Omya North America located in Proctor, Vt.; and sixty parts of Kaocal®, a commercial form of clay marketed by J. M. Huber Corporation located Borger, Tex. In other examples, the first sub-layer (305) has sixty parts of Kaocal® and forty parts of Opacarb® A40, a commercial form of calcium carbonate pigments, marketed by Specialty Minerials, Inc, located in Adams, Mass. In some examples, the first sub-layer (305) has three to twelve parts of a solution that is made of twenty five parts of Pluriol® E600, which is a commercial form of polyethylene glycol also marketed by BASF, The Chemical Company; twenty five parts of calcium chloride ($CaCl_2$), and fifty parts water. In some examples, the first sub-layer (305) also has seven parts of Acronal® S728, a commercial form of styrene acrylic latex marketed by BASF, The Chemical Company, headquartered in Ludwigshafen, Germany.

Table 3 below includes specific examples of formulations of first sub-layers that may be used with the principles described herein.

TABLE 3

| | First Sub-layer Examples | | | |
|---|---|---|---|---|
| | 1.1 | 1.2 | 1.3 | 1.4 |
| Hydrocarb ® 90 | 40 | 40 | 40 | |
| Kaocal ® | 60 | 60 | 60 | 60 |
| Opacarb ® A40 | | | | 40 |
| Premix | 12 | 6 | 3 | 12 |
| Acronal ® S728 | 7 | 7 | 7 | 7 |
| Total Parts | 119 | 113 | 110 | 119 |
| Coat Wt (gsm) | 10 | 10 | 10 | 10 |

In some examples, the premix solution in the chart above may include twenty five parts of Pluriol E600, twenty five parts of calcium chloride ($CaCl_2$), and fifty parts water ($H_2O$).

While the coatings and sub-layers have been described with particular examples from a non-exhaustive list, any combinations of material in various amounts that perform the functions described above are within the scope of the principles described herein.

EXAMPLES

The following examples are exemplary or illustrative of the application of the principles of the subject innovation. It will be noted that experimental data provided does not limit the scope of the embodiments. Rather, such data merely illustrate the preparation of composition embodiments in accordance with the subject innovation as well as for demonstrating the properties described above illustrating the usefulness of the composition for coated media.

Unless otherwise indicated in the following examples and elsewhere in the specification and claims, all parts and percentages are by weight, all temperatures are in degrees Centigrade, and pressure is at or near atmospheric pressure.

(a) Preparation of the Composition for Coated Media

The First Sub-layer (FSL) composition was prepared by first adding water to a small container, then adding 40 parts of Hydrocarb® 90, a commercial form of calcium carbonate marketed by Omya North America located in Proctor, Vt.; and 60 parts of Kaocal®, a commercial form of clay marketed by J. M. Huber Corporation located Borger, Tex., and mixing for 10 minutes. Separately, the premix solution was prepared by mixing 25 parts of Pluriol E600, which is a commercial form of polyethylene glycol marketed by BASF, 25 parts of calcium chloride ($CaCl_2$), and 50 parts water ($H_2O$). Then, 12 parts of the premix was added to the pigment mixture and mixed for 5 minutes. In the end, 7 parts of Acronal® S728, a commercial form of styrene acrylic latex marketed by BASF, headquartered in Ludwigshafen, Germany, was added to the mixture of pigment and premix solution.

The Second Sub-layer (SSL) composition was prepared by first adding water to a small container. Then, 100 parts of Sylojet® A25, a commercial form of silica marketed by W. R. Grace & Co. located in Columbia, Md., was added to the container and stirred for 5 minutes. 5 parts of Glascol® F207 an organic polyelectrolyte marketed by BASF, was added to the container and stirred for 5 minutes. Separately, MOWIOL® 20-98 PVA from Kuraray America, Inc, located in Houston, Tex., a water soluble binder was cooked in water at 95® C. for 20 min minutes. 20 dry parts of cooked PVA was added to the mixture in the container and mixed for 10 minutes. In the end, 0.5 parts of Tinopal ABP-A, an optical brightening agent and 0.005 parts of Irgalite Blue R-L, a blue dye, both available from BASF Chemical Company was added and mixed for 2 minutes.

The first top coating (TC3.1) composition was prepared by first adding water in to a small container. Then, 100 parts of Cartacoat® K303C, a commercial form of silica marketed by Clariant Corporation located in Charlotte, N.C.; 3 parts of Mowiol® 18-88, a commercial form of polyvinyl alcohol ($(C_2H_4O)_x$) marketed by Kuraray America, Inc located in Houston, Tex.; 0.5 parts of Michemshield® 253 slip aid from Michelman, Inc., located in Cincinnati, Ohio; 0.5 parts of Tinopal ABP-A, an optical brightening agent and 0.005 parts of Irgalite Blue R-L, a blue dye, both available from BASF Chemical Company was added and mixed for 10 minutes. The second top coating (TC3.2) composition was prepared by first adding water in to a small container. Then, 100 parts of Cartacoat® K303C, a commercial form of silica marketed by Clariant Corporation located in Charlotte, N.C.; 3 parts of Mowiol® 18-88, a commercial form of polyvinyl alcohol ($(C_2H_4O)_x$) marketed by Kuraray America, Inc located in Houston, Tex.; 1 parts of Michemshield® 253 slip aid from Michelman, Inc., located in Cincinnati, Ohio; 0.5 parts of Tinopal ABP-A, an optical brightening agent and 0.005 parts of Irgalite Blue R-L, a blue dye, both available from BASF Chemical Company was added and mixed for 10 minutes. The third top coating (TC3.3) composition was prepared by first adding water in to a small container. Then, Laponite® JS Nano Clay, which is commercial forms of clay marketed by Rockwood Additives Limited located in Widnes, Cheshire, United Kingdom; 3 parts of Mowiol® 18-88, a commercial form of polyvinyl alcohol ($(C_2H_4O)_x$) marketed by Kuraray America, Inc located in Houston, Tex.; 0.5 parts of Michemshield® 253 slip aid from Michelman, Inc., located in Cincinnati, Ohio; 0.5 parts of Tinopal ABP-A, an optical brightening agent and 0.005 parts of Irgalite Blue R-L, a blue dye, both available from BASF Chemical Company was added and mixed for 10 minutes.

(b) Coated Medium Preparation

The coated medium samples 1, 2 and 3 were prepared by applying 10 gsm coat weight of first sub-layer (FSL-1.2) on a 90 gsm HP LaserJet plain paper. Then, 3 gsm of second sub-layer (SSL-2.1) was applied on top of first sub-layer (FSL-1.2). Subsequently, 0.5 gsm of top coating (TC-2.1, 3.2 & 3.1) was applied on top of second sub-layer (SSL-2.1). The coating layers were applied using a wire-wound Mayer rod on a benchtop drawdown table. The coated samples were air dried using a hand held heat gun for 1 minute after applying the each coating layer. Table 4 provides a listing of the three coated medium samples (1, 2 and 3) and a control commercial matte coated inkjet paper 120 gsm.

Table 4 below includes specific examples of coated medium.

TABLE 4

| | Medium Examples | | | |
|---|---|---|---|---|
| | 1 | 2 | 3 | Control |
| First Sub-layer (FSL) ID | FSL-1.2 | FSL-1.2 | FSL-1.2 | Commercial |
| FSL Coat Weight (gsm) | 10 | 10 | 10 | Matte Coated |
| Second Sub-layer (SSL) ID | SSL-2.1 | SSL-2.1 | SSL-2.1 | InkJet Paper, |
| SSL Coat Weight (gsm) | 3 | 3 | 3 | 120 gsm. |
| Top Coating (TC) ID | TC-3.1 | TC-3.2 | TC-3.3 | |
| TC Coat Weight (gsm) | 0.5 | 0.5 | 0.5 | |
| Total Coat Weight (gsm) | 13.5 | 13.5 | 13.5 | |

The coefficient of friction (COF) of the examples media was measured using the Lab Master® Slip and Friction TMI tester with 1360 g sled weight, 2 cm/min static speed and 76 cm/min kinetic test speed. The printer sheet pick reliability and runnability may be characterized by the COF of sheet to sheet, and sheet to rubber pick-up rollers (if used for paper pickup). The COF is an integrated parameter indicating the chemical and physical properties of the media, examples of which include, but are not limited to surface polarity, roughness, porosity and permeability, moisture and the like. As shown in Table 5, the media examples of 1, 2 & 3 provided lower sheet to sheet COF relative to control media.

The coated samples were printed on two different printers using premium presentation normal print mode settings with standard ink cartridges. HP OfficeJet Pro 8000 pigment based inks and HP OfficeJet 6500 dye inks based printers were used to evaluate the image quality of coated medium 1, 2, 3 & control sample. The image quality tests included evaluation of standard optical density (OD), black point (L*min) and color Gamut using above-mentioned inkjet printers and inks. Black point (L*min) and black optical density (KOD) were measured using a transmission/reflection densitometer, supplied by X-rite, Green Rapids, Mich. The Color Gamut volume was calculated based on X-Rite transmission/reflection densitometer measurements of L*, a*, and b* from 8 color patches (100% cyan, 100% magenta, 100% yellow, 100% red, 100% green, 100% blue, 100% black and white (unprinted area)). The higher values of KOD and Gamut and lower value of L*min in Table 5 indicates better performance of the respective samples.

Table 5 below includes coefficient of friction (COF) and image quality data for specific examples of coated medium.

TABLE 5

| | | Medium Examples | | | |
|---|---|---|---|---|---|
| | | 1 | 2 | 3 | Control |
| Coefficient of Friction (COF) | Static | 0.70 | 0.64 | 0.77 | 0.86 |
| | Kinetic | 0.69 | 0.58 | 0.73 | 0.81 |
| OfficeJet Pro 8000, Pigment Inks Image Quality | Gamut | 263077 | 296086 | 309436 | 263659 |
| | L*min | 22.1 | 19.2 | 19.5 | 21.7 |
| | KoD | 1.46 | 1.55 | 1.56 | 1.47 |
| OfficeJet 6500, Dye Inks Image Quality | Gamut | 337287 | 328787 | 310003 | 303787 |
| | L*min | 14.2 | 15.2 | 14.3 | 18.8 |
| | KoD | 1.75 | 1.71 | 1.70 | 1.56 |

Figure 4:
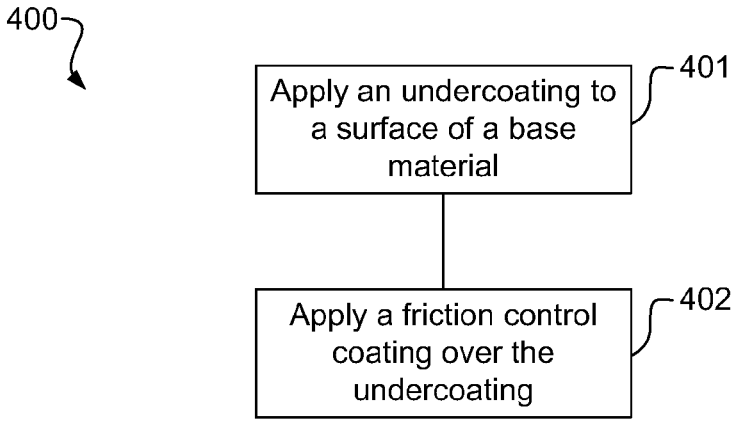
FIG. 4 is a diagram of a flowchart of an illustrative method for forming a print medium, according to principles described herein.

FIG. 4 is a diagram of a flowchart of an illustrative method (400) for forming a print medium, according to principles described herein. In this example, the method (400) includes applying (401) an undercoating to a surface of a base material and applying (402) a top coating over the undercoating. The top coating may have pigment particles sizes less than a hundred nanometers and frictional control additives, and the undercoating may have colorant fixative agents.

The undercoating may be applied in two applications. The first application may include applying a first sub-layer to the surface of the base material. The second application may include applying a second sub-layer over the first sub-layer. Each of the sub-layers may contain colorant fixative agents. In some examples, the first sub-layer contains pigment fixative agents, and the second sub-layer contains dye fixative agents.

In some examples, the top coating, undercoating, sub-layers, or combinations thereof may be premixed in an aqueous solution and then applied to the medium. The aqueous coating may be applied through slotted die applications, roller applications, fountain curtain applications, blade applications, rod applications, air knife applications, gravure applications, air brush applications, other aqueous coating applications, or combinations thereof.

In some examples, the base material is pre-coated with an adhesive material to improve the base material's bond with the first sub-layer. After each application, the sub-layers may be dried. The sub-layers and/or coatings may be dried through conduction, convection, radiation, atmospheric conditions, or combinations thereof.

In some examples, the coatings and the base material are flattened by rollers after the aqueous coatings are applied. In some examples, the rollers are heated to dry the aqueous coatings, improve the bond between coatings, improve the bond of the coatings to the base material, flatten the medium, prevent the medium from curling, or combinations thereof. In some examples, the medium is subjected to a process referred to as calendaring where heated rollers flatten the medium after the coatings are applied.

By way of a specific example, the first sub-layer may be applied to the base material through with an aqueous coating roller application and actively dried through radiation. Next, the second sub-layer may be applied to the top of the first sub-layer with an aqueous coating roller application and actively dried through radiation. Finally, the top coating may applied to the base material through with an aqueous coating roller application and actively dried through radiation.

The top coating may improve the durability of an image formed by the colorant binding to the colorant fixative agent sub-layers beneath the top coating. The top coating may insulate the colorant from external forces on the medium, such as objects coming into contact with the top coating. For example, if a hand, book, other sheet of media, ring, or other object comes into contact with the medium, the object will directly contact the top coating. Since the colorant is not in the top coating, the colorant may be spared from direct contact with the object.

Figure 5:
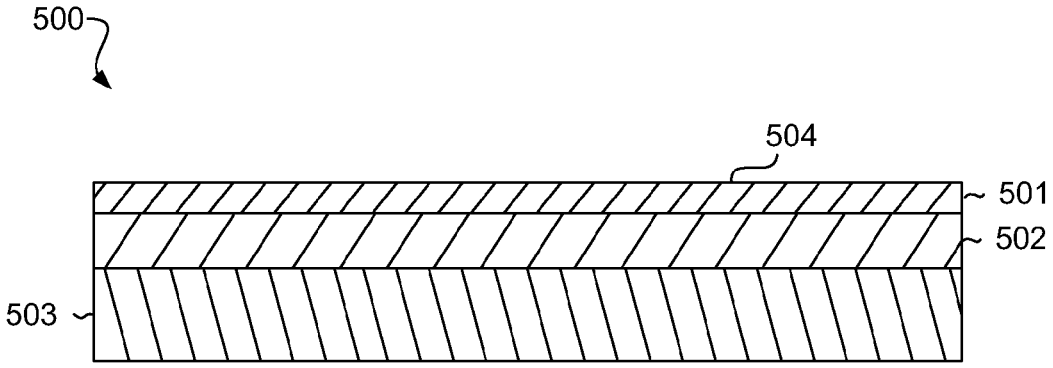
FIG. 5 is a cross sectional diagram of an illustrative print medium, according to principles described herein.

FIG. 5 is a cross sectional diagram of an illustrative print medium (500), according to principles described herein. In this example, the medium (500) has a top coating (501) and an undercoating (502) deposited on a base material (503).

The base material (503) may be a fiber based material, a plastic, a transparent material, an opaque material, paper, cardstock, fabric, other base materials used in printing media, or combinations thereof. In some examples, the base material (503) is pre-coated with a material to improve adhesion between the base material (503) and the undercoating (502).

The undercoating (502) may include colorant fixative agents for both dye colorants and pigment colorants mixed together. A non-exhaustive list of pigment fixative agents that may be used in the undercoating (502) includes a pigment colorant fixative agent such as multi-valent salts, calcium chloride ($CaCl_2$), calcium acetate ($Ca(C_2H_3OO)_2$), calcium citrate ($Ca_3(C_6H_5O_7)_2$), magnesium sulfate ($MgSO_4$), aluminum chlorohydrate ($Al_nCl_{(3n-m)}(OH)_m$), or combinations thereof. A non-exhaustive list of dye fixative agents that may be used in the undercoating (502) includes cationic fixative agents, polydiallyldimethylammonium chloride (PolyDADMAC), polyamines, polyhexamethylene biguanide (PHMB), other dye fixative agents, or combinations thereof. These colorant fixative agents may be mixed together in any combination within the undercoating (502).

In some examples, the dye fixative agents and the pigment fixative agents are equally distributed throughout the undercoating (502). In alternative examples, the pigment fixative agents have an unequal distribution across the thickness of the undercoating (502). For example, more pigment fixative agents may be concentrated towards the bottom of the undercoating's thickness, which is adjacent to the base material (503). In some examples, the pigment fixative agents have an unequal distribution throughout the undercoating (502), while the dye fixative agents have a substantially equal distribution throughout the undercoating (502). In some examples, the dye fixative agents have an unequal distribution throughout the undercoating (502). For example, the dye fixative agents may have a greater concentration towards the top coating (501). In some examples, the dye fixative agents have an unequal distribution while the pigment fixative elements have a substantially equal distribution.

The top coating (501) may be deposited over the undercoating (502). The top coating (501) may have a porous structure that pulls colorant and/or ink that is deposited on the surface (504) of the top coating (501) into the plurality of coatings through a capillary force. The top coating (501) may be made of clay, mineral, talc, ground calcium carbonate, precipitated calcium carbonate, silica, earth materials, synthetic materials, or combinations thereof. These materials may have small pigment particles that are sized less than a hundred nanometers.

The small size of the particles in the top coating (501) provides the surface of the coating (501) with a large numbers of pores between the particles. These pores have small diameters which provide a strong capillary force that causes fast absorption. The ink and/or colorant may be pulled through these pores into the undercoating (502) through the capillary force. Further, the small size of these top coating's particles may keep the top coating's coefficient of friction low. The top coating (501) may also include a friction control additive. The friction control additive may also contribute to reducing the coefficient of friction on the top coating's surface (504).

The top coating (501) may be relatively thin. In some examples, the top coating (501) has a thickness under ten micrometers, which may correspond to a weight of less than ten grams per square meter. In some examples, the thickness is less than five micrometers, which may correspond to a weight of less than five grams per square meter. Yet, in other examples, the thickness is less than one micrometer, which may correspond to a weight of less than one grams per square meter. In some examples, the thickness is less than 0.5 micrometers, which may correspond to a weight of less than 0.5 grams per square meter.

In some examples, a weight of the top coating (501) is less than twenty five percent of a coat weight of the undercoating (502). In some examples, the undercoating (502) is at least twenty times heavier than the top coating (501).

Figure 6:
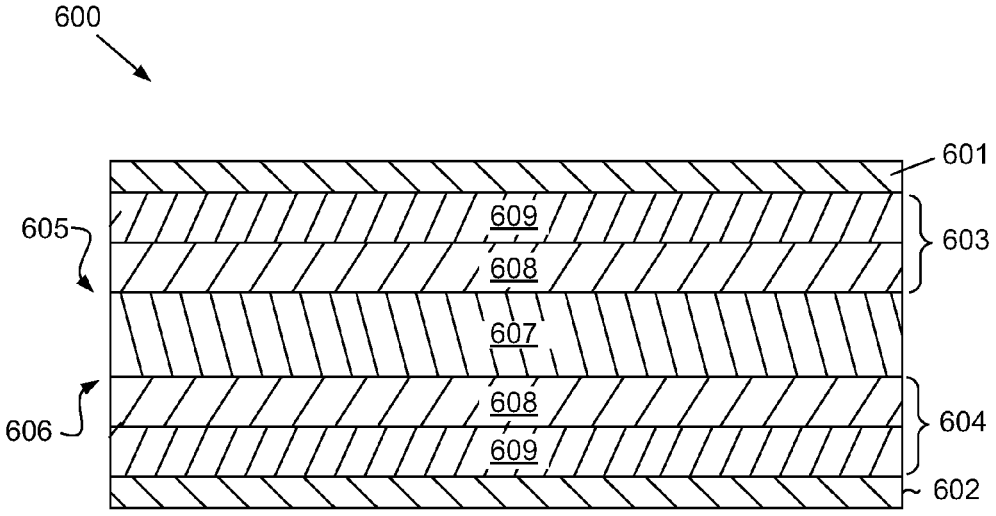
FIG. 6 is a cross sectional diagram of an illustrative print medium, according to principles described herein.

FIG. 6 is a cross sectional diagram of an illustrative print medium (600), according to principles described herein. In this example, the medium (600) has a first top coating (601) and a second top coating (602) over a first undercoating (603) and a second undercoating (604) respectively. The first and second undercoatings (603, 604) are deposited on a first side (605) and a second side (606) of a base material (607). The undercoatings (603, 604) have a first sub-layer (608) and a second sub-layer (609) each. The top coatings (602, 603) may be friction control coatings, and the undercoatings (603, 604) may be colorant fixative coatings.

In the example of FIG. 6, the two sub-layers (608, 609) of the undercoatings (603, 304) each include colorant fixative agents. The colorants in the ink may be dye colorants, pigment colorants, or combinations thereof. In the example of FIG. 6, the first sub-layers (608) are positioned adjacent to the base material (607). These sub-layers (608) may include pigment fixative agents. Further, the second sub-layers (609) may include dye fixative agents.

The top coatings (601, 602) may be deposited over the undercoatings (603, 604). The top coatings (601, 602) may have porous structures that pull colorant and/or ink that is deposited on the top coatings into the undercoatings (703, 704) through a capillary force.

The top coatings (601, 602) include clay particles, mineral particles, ground calcium carbonate, precipitated calcium carbonate, talc particles, silica particles, alumina particles, or combinations thereof. These materials may have small particles that are sized less than a hundred nanometers.

The top coatings (601, 602) may also include friction control additives. The friction control additives may contribute to reducing the top coatings' coefficients of friction. The top coatings (601, 602) may be relatively thin. In some examples, the top coatings (601, 602) have thicknesses under ten micrometers. In some examples, the thicknesses of the top coatings are less than five micrometers. Yet, in other examples, the thicknesses are less than one micrometer. In some examples, the thicknesses are less than 0.5 micrometer. In some examples, the top coatings (601, 602) have coating weights of less than ten grams per square meter.

Figure 7:
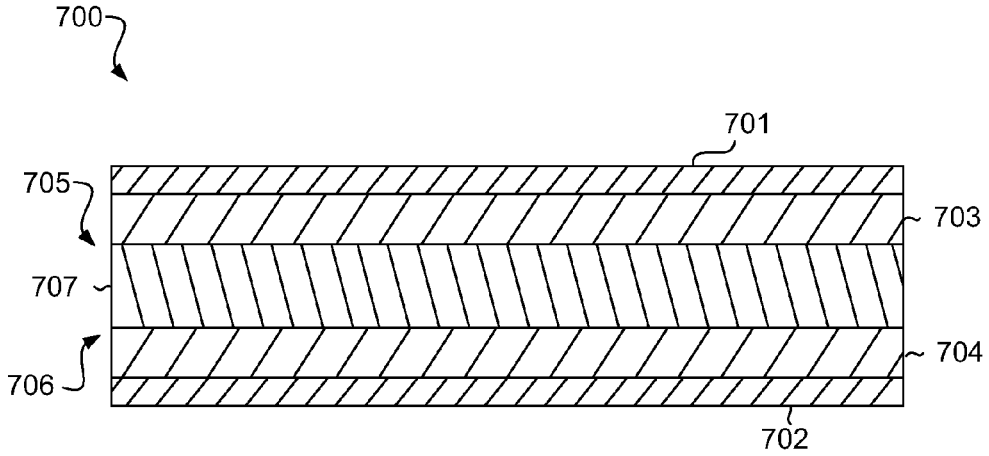
FIG. 7 is a cross sectional diagram of an illustrative print medium, according to principles described herein.

FIG. 7 is a cross sectional diagram of an illustrative print medium (700), according to principles described herein. In this example, the medium (700) has a first top coating (701) and a second top coating (702) over a first undercoating (703) and a second undercoating (704) respectively. The first and second undercoatings (703, 704) may be deposited onto a first side (705) and a second side (706) of a base material (707).

The undercoatings (703, 704) may include colorant fixative agents for both dye colorants and pigment colorants mixed together. In some examples, the dye fixative agents and the pigment fixative agents are equally distributed throughout the undercoatings (703, 704). In alternative examples, the pigment fixative agents have unequal distributions across the thicknesses of the undercoatings (703, 704). In some examples, the undercoatings have dye fixative agents or pigment fixative agents, but not both.

The top coatings (701, 702) may be deposited over the undercoatings (703, 704). The top coatings (701, 702) may have porous structures that pull colorant and/or ink deposited on the top coatings (701, 702) into the undercoatings (703, 704) below.

In some examples, the base material (707) is pre-coated with an adhesive material to improve the base material's bond with the undercoatings (703, 704). After each application, the undercoatings (703, 704) may be dried.

In some examples, colorant fixative agents are be mixed into and dispersed within the base material. For example, the pigment fixative agents may be mixed into the base material. In some examples, the undercoating includes the dye fixative agents, while the pigment fixative agents are mixed into the base material.

While the medium has been described with certain numbers of coatings and sub-layers, any number of coating and sub-layers made with various concentrations of colorant fixative agents may be compatible with the principles described herein.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A print medium, comprising:

a porous top coating comprising pigment particles sized less than a hundred nanometers and frictional control additives; and an undercoating disposed between a base material and said top coating, said undercoating comprising:

a first sub-layer comprising a pigment fixative agent, wherein said pigment fixative agent comprises calcium chloride, calcium acetate, calcium citrate, or combinations thereof;

a second sub-layer comprising a dye fixative agent, wherein said dye fixative agent comprises cationic fixative agents, polydiallyldimethylammonium chloride, polyamines, polyhexamethylene biguanide, or combinations thereof; and a boundary separating the first sub-layer from the second sub-layer, the boundary having been formed by applying each of the first sub-layer and the second sub-layer separately;

wherein the top coating forms a protective and low friction coating over the undercoating;

and wherein the friction control additives are non-polar and liquid at room temperature.

2. The medium of claim 1, wherein said second sub-layer is disposed between said first sub-layer and said top coating.

3. The medium of claim 1, wherein said particles comprise at least one of: clay particles, mineral particles, ground calcium carbonate, precipitated calcium carbonate, talc particles, silica particles, alumina particles, and combinations thereof.

4. The medium of claim 1, wherein said frictional control additives comprise at least one of: a non-polar hydrocarbon synthetic polymer emulsion or dispersion, polyethylene; synthetic polymers, polyethylene powder, waxes, carnauba waxes, paraffin, lubricants, and combinations thereof.

5. The medium of claim 4, wherein said top coating comprises a ratio of pigment particles to friction control additives between 90:10 to 99:1.

6. The medium of claim 4, wherein said top coating is transparent and has a coating weight less than ten grams per square meter.

7. The medium of claim 1, wherein said undercoat weight is less than twenty grams per square meter, with the first sub-layer comprising a coat weight of at least 3 grams per square meter and the second sub-layer comprising a coat weight of at least 5 grams per square meter.

8. The medium of claim 1, wherein the second sub-layer comprises a combination of dye and pigment fixative agents.

9. A method of forming a print medium, comprising:

applying a first sub-layer of an undercoating to a surface of a base material, the first sub-layer including a pigment fixative agent, wherein said pigment fixative agent comprises calcium chloride, calcium acetate, calcium citrate, or combinations thereof;

drying the first sub-layer through conduction, convection, radiation, atmospheric conditions, or a combination thereof;

then, applying a second sub-layer of the undercoating over the first sub-layer, the second sub-layer including a dye fixative agent, wherein said dye fixative agent comprises cationic fixative agents, polydiallyldimethylammonium chloride, polyamines, polyhexamethylene biguanide, or combinations thereof;

drying the second sub-layer through conduction, convection, radiation, atmospheric conditions, or a combination thereof, thereby forming said undercoating; and applying a porous top coating over said undercoating, said top coating comprises particles sized less than a hundred nanometers and hydrophobic, friction control additives, wherein said top coating comprises a ratio of pigment particles to friction control additives between 50:50 to 99:1;

wherein the friction control additives have a liquid state at room temperature.

10. A print medium, comprising:

a porous top coating formed over an undercoating, the top coating comprising a liquid friction control additive; and said undercoating formed over a base material, the undercoating including:

a first sub-layer including a pigment fixative agent, wherein said pigment fixative agent comprises calcium chloride, calcium acetate, calcium citrate, or combinations thereof;

a second sub-layer including a dye fixative agent, wherein said dye fixative agent comprises cationic fixative agents, polydiallyldimethylammonium chloride, polyamines, polyhexamethylene biguanide, or combinations thereof; and a boundary separating the first sub-layer from the second sub-layer;

wherein said top coating comprises a coat weight that is less than twenty five percent of an undercoat weight of said undercoating.

11. The medium of claim 10, wherein said undercoat weight is less than one gram per square meter.

12. The method of claim 9, wherein said undercoat weight is less than twenty grams per square meter.

13. The medium of claim 10, wherein the top coating comprises pigment particles and friction control additives, wherein said top coating comprises a ratio of pigment particles to friction control additives between approximately 90:10 to 99:1 and the fiction control additives comprise at least one of: a non-polar hydrocarbon synthetic polymer emulsion or dispersion, polyethylene; synthetic polymers, polyethylene powder, waxes, carnauba waxes, paraffin, and combinations thereof.

14. The medium of claim 1, wherein said top coating comprises a ratio of pigment particles to friction control additives between 50:50 to 99:1, the friction control additives comprising non-polar materials and a majority of a top surface of the top coating is friction control additives.

15. The medium of claim 10, wherein a majority of a top surface of the top coating is non-polar, organic material.

16. The medium of claim 1, wherein the base material includes colorant fixative agents.

17. The medium of claim 1, wherein the first sub-layer excludes dye fixative agents.

* * * * *